United States Patent [19]

Björn

[11] 3,985,594

[45] Oct. 12, 1976

[54] METHOD OF REDUCING THE MUZZLE FLASH WHEN FIRING FIREARMS LOADED WITH POWDER, AND POWDER FLASH-REDUCING AGENT INTENDED FOR THIS PURPOSE

[75] Inventor: Lars-Erik Björn, Karlskoga, Sweden

[73] Assignee: AB Bofors, Bofors, Sweden

[22] Filed: June 16, 1975

[21] Appl. No.: 587,524

[30] Foreign Application Priority Data

July 9, 1974 Sweden ..... 7408996

[52] U.S. Cl. ..... 149/108.4; 423/617

[51] Int. Cl.[2] ..... C06B 25/02; C01B 27/00

[58] Field of Search ..... 149/100, 108.4, 19.8, 149/20; 423/617, 593

[56] References Cited

UNITED STATES PATENTS

| | | | |
|---|---|---|---|
| 1,211,564 | 1/1917 | Eyer | 423/593 |
| 1,838,346 | 12/1931 | Woodbridge | 149/100 |
| 2,035,471 | 3/1936 | Hale | 149/100 |
| 2,301,043 | 11/1942 | Hardy | 149/100 |
| 2,304,037 | 12/1942 | Thomson | 149/100 |
| 2,439,281 | 4/1948 | Barsky | 149/100 |
| 3,086,896 | 4/1963 | Trask | 149/19.8 |

*Primary Examiner*—Samuel Feinberg
*Assistant Examiner*—Donald P. Walsh
*Attorney, Agent, or Firm*—Pollock, VandeSande & Priddy

[57] ABSTRACT

Sodium hexahydroxy antimonate is added to powder and acts as a flash-reducing agent.

4 Claims, No Drawings

METHOD OF REDUCING THE MUZZLE FLASH WHEN FIRING FIREARMS LOADED WITH POWDER, AND POWDER FLASH-REDUCING AGENT INTENDED FOR THIS PURPOSE

The present invention relates to a new method of reducing the flash when firing a firearm loaded with powder, and a new type of flash-reducing agent which, contrary to the case of previously known flash-reducing agents, has a very low solubility in water.

When firing with artillery and other firearms, it is desired to prevent a muzzle flash from being formed at the firing, to the extent possible. It has been known for a long time that in many cases the muzzle flash can be prevented where it would otherwise have occurred if a small quantity of potassium or sodium salt is added to the powder charge. However, such salts must fulfill certain requirements if they are to be used as flash-reducing agents, and this has limited the choice to a considerable extent. Thus, for instance, a flash-reducing agent must not have any detrimental influence on the stability of the powder, and it should contribute as little as possible towards the formation of smoke at the firing, at the same time as it should not give rise to corrosive combustion products, but should preferably have a corrosion-inhibiting effect on the barrel. Nor can strongly hygroscopic salts be used which can induct water into the powder and thereby spoil the powder.

The sodium and potassium salts hitherto used as flash-reducing agents have a solubility in water corresponding to approx. 5–20 % at the temperatures prevailing when water is present during the manufacture of the powder. In most conventional methods for manufacturing powder, the solubility in water of the flash-reducing agent therefore constitutes a certain disadvantage, but no unsurmountable problem, even if the total loss of flash-reducing agent which has been dissolved in the water which always is present at one or several of the stages in the manufacture of powder constitutes a cost which is not negligible.

In the cases when it has been possible to incorporate the flash-reducing salt which is soluble in water in the powder in some stage of the processing in which solvent is present, it has usually been possible to bind the salt in a satisfactory way, but the problem immediately becomes greater when it is a question of producing porous powder by soaking out other easily soluble salts which have been worked into the powder, or at the manufacture of so-called ball powder in water.

We have now, quite surprisingly, found an entirely new flashreducing agent which, as far as we known, has never before been used for powder. We have found that the salt sodium antimonate (sodium hexahydroxy antimonate $NaSb(OH)_6$), which has low solubility in water, fulfills all of the requirements which at present can reasonably be stipulated for a flashreducing agent for powder. When using sodium antimonate as a flash-reducing agent for powder it has proved to be appropriate to add up to 5% sodium antimonate, by weight based on the quantity of powder. In most cases, an entirely satisfactory effect is obtained if no more than 1.5% sodium antimonate is added. Due to its low solubility in water, the sodium antimonate can be worked into the powder even when large quantities of water are present.

The flash reducing agent can be added, during the manufacture of the powder, at a stage when the powder still contains solvent, since the presence of ether ethanol, acetone or other solvents used in the manufacture of powder does not constitute any obstacle whatsoever. The advantages of having a flash-reducing agent which is so difficult to dissolve in water as sodium antimonate are obvious, as water can quite simply be added to the powder for soaking out solvents or easily soluble salt, for the manufacture of porous powders. The content of undesirable substances in the soaking water are also reduced considerably with this type of flash-reducing agent, at the same time as the undesirable losses of flash-reducing agent are reduced to an absolute minimum. The use of a flash-reducing agent which is so difficult to dissolve also permits the presence of water in more stages of the manufacture of powder than previously, and ball powder can also be provided with a desirable flash-reducing additive in a more simple way than previously.

The flash reducing agent can be added, during manufacture of the powder, at the same stage of manufacture as the cellulose nitrate constituent of the powder. When the powder is triple-base powder, the flash reducing agent of the present invention can be added together with the nitro-guanidine used in such powder, during the manufacture of the powder. When the powder is double-base powder, the flash-reducing agent can be added together with the combustion modifier during the manufacture of the powder.

The invention has been specified in the following claims, and the following example is given.

EXAMPLE

In order to investigate the flash-reducing effect of the sodium hexahydroxy antimonate, three different powders of a type otherwise previously known were manufactured in a conventional way, with the following composition.

| | I<br>% by weight | II<br>% by weight | III<br>% by weight |
|---|---|---|---|
| Cellulose nitrate | 91.0 | 89.5 | 89.5 |
| Glycerol trinitrate | 5.0 | 5.0 | 5.0 |
| Diphenylamine | 1.0 | 1.0 | 1.0 |
| Dinitrotoluene | 1.5 | 1.5 | 1.5 |
| Trinitrotoluene | 1.5 | 1.5 | 1.5 |
| Potassium hydrogen tartrate (previously known type of flash-reducing agent) | — | 1.5 | — |
| Sodium hexahydroxy antimonate | — | — | 1.5 |

Firing tests of the powder were carried out with calibre 7.62 mm, and the flash was judged visually.

Test I, which did not have any special flash-reducing agent at all, gave a big flash, while both test II, which contained the older type of flash-reducing agent, potassium hydrogen tartrate, and test III, which contained our new flash-reducing agent sodium hexahydroxy antimonate, did not give any flash at all.

I claim:

1. A method of reducing the muzzle flash formed when firing firearms loaded with powder, comprising adding up to 5% by weight of the salt sodium hexahydroxy antimonate to the powder.

2. A method according to claim 1, wherein the amount of sodium hexahydroxy antimonate added to the powder does not exceed 1.5% by weight.

3. A method according to claim 1, wherein the sodium hexahydroxy antimonate is added to the powder at a stage of the manufacture of the powder at which the powder still contains solvent.

4. A combustible powder for use in firing a firearm, the powder including a flash-reducing agent as a constituent thereof consisting of sodium hexahydroxy antimonate.

* * * * *